US005555571A

United States Patent [19]

McCaffrey

[11] Patent Number: 5,555,571

[45] Date of Patent: Sep. 17, 1996

[54] COLLAPSIBLE DIVING MASK

[76] Inventor: Scott A. McCaffrey, 59 Oakden Ave., South Weymouth, Mass. 02190

[21] Appl. No.: 287,146

[22] Filed: Aug. 8, 1994

[51] Int. Cl.[6] ..... A61F 9/02

[52] U.S. Cl. ..... 2/428; 2/441; 2/452; 2/454

[58] Field of Search ..... 2/428, 430, 441, 2/440, 452, 454

[56] References Cited

U.S. PATENT DOCUMENTS

D. 302,747 8/1989 Hattori .
D. 309,508 7/1990 Sugita .
2,321,159 6/1943 Ryan ..... 2/441
3,694,814 10/1972 De Barbieri et al. ..... 2/428
3,725,953 4/1973 Johnson et al. ..... 2/428
4,607,398 8/1986 Faulconer ..... 2/452

*Primary Examiner*—Peter Nerbun
*Attorney, Agent, or Firm*—Bookstein & Kudirka, P.C.

[57] ABSTRACT

A SCUBA diving mask body is completely comprised of flexible material so that the mask can be folded into a small package. The inventive mask comprises a flexible rubber body which integrally incorporates the mask skirt. A rigid lens for each eye is inserted into a socket in the body. The mask strap is attached to the flexible body by means of two adjustable strap holders.

21 Claims, 1 Drawing Sheet

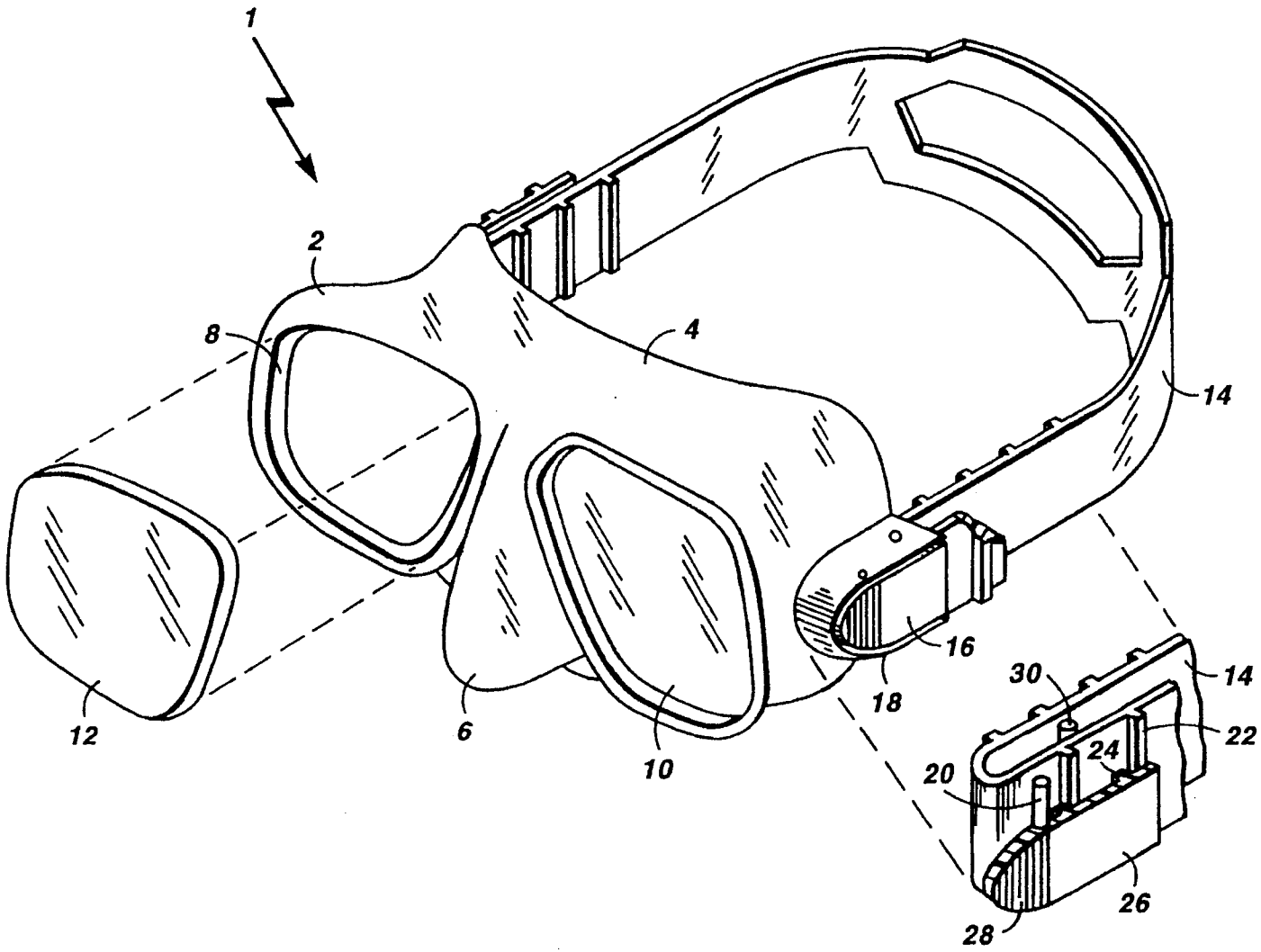
1
2
4
6
8
10
12
14
14
16
18
20
22
24
26
28
30

COLLAPSIBLE DIVING MASK

FIELD OF THE INVENTION

This invention relates to SCUBA diving equipment and particularly to masks use for SCUBA diving.

BACKGROUND OF THE INVENTION

Conventional diving masks made for SCUBA diving usually comprise four main parts. The first part is a rigid frame which generally is constructed of a plastic material and extends across the width of the diver's face. The frame is used to stabilize the mask and provide an attachment point for the remaining mask parts. Attached to the rigid frame is a flexible skirt usually made of rubber, either neoprene rubber or, preferably silicone rubber, which seals the mask tightly to the diver's face. The skirt is generally molded with a lip that snaps into a groove in the frame, but alternatively, the rubber skirt may be glued into the frame In order to be useful for SCUBA diving, the mask must enclose the diver's nose in such a manner that the space between the mask and the diver's face can be equalized on descent under water by exhaling through the nose. In addition, the mask must be designed so that a diver can reach and squeeze his nostrils together from outside of the mask in order to aid in equalizing the diver's inner ear spaces. Consequently, the rubber skirt is molded to include a flexible nose "pocket" which encloses the diver's nose.

The frame also holds one or more rigid lenses positioned in front of the diver's eyes. The lenses are usually fabricated from tempered glass for optical clarity and to resist scratching. The lenses are seated in recesses in the frame against a portion of the body which acts as a gasket or against a separate flexible gasket. Once seated, the lenses are held in place with a retaining ring or other suitable device for maintaining a water-tight seal.

The mask is also provided with a strap for holding it on the diver's head, which strap is connected to the rigid frame. The strap is made adjustable by connecting it to the frame by a pair of adjustment mechanisms that allow the strap length to be adjusted to fit to various head sizes.

One problem with such a conventional mask is that the rigid frame is relatively heavy and bulky. In addition, since the frame is relatively large, it prevents the mask from being folded so that it can be carried in a pocket or other convenient location as a spare mask. Accordingly, many divers do not carry a spare mask, but, unfortunately, if a diver does not have a spare mask and his mask becomes broken, the mask is often useless and the dive is ended prematurely if the diver is on a boat several miles out at sea.

Further, the frame often blocks ambient light from reaching the diver's eyes during a dive, thereby contributing to the feeling of"claustrophobia" often encountered by many people during a dive.

Accordingly, it is an object of the present invention to provide a SCUBA diving mask which can be folded into a package small enough to be inserted into a pocket.

It is another object of the present invention to provide a SCUBA diving mask which is relatively light-weight.

It is a further object of the present invention to provide a SCUBA diving mask which admits more light than prior art diving masks and thus reduces the feeling of "claustrophobia".

SUMMARY OF THE INVENTION

The foregoing problems are solved and the foregoing objects are achieved in accordance with one illustrative embodiment of the invention in which a SCUBA diving mask body is completely comprised of flexible material so that the mask can be folded into a small package. The inventive mask comprises a flexible rubber body which integrally incorporates the mask skirt. A rigid lens for each eye is inserted into a socket in the body. The mask strap is attached directly to the flexible body by means of two adjustable strap holders.

In accordance with the principles of the invention, a collapsible mask is created which can be used easily as a spare mask. The mask is lightweight because no heavy frame is incorporated and, consequently, the mask can be carried by a diver even underwater as a spare mask to provide additional redundancy. If the diver's primary mask gets knocked off or leaks during a dive, the collapsible mask is immediately available. In addition, since the frame is absent, if the body is made out of translucent material, a substantial amount of light is admitted to the diver's eyes, thereby avoiding the aforementioned claustrophobia problem.

BRIEF DESCRIPTION OF THE DRAWING

FIG. 1 is a perspective diagram of the inventive collapsible mask with an enlarged view of an illustrative strap adjustment mechanism.

DETAILED DESCRIPTION OF THE PREFERRED EMBODIMENT

FIG. 1 is a perspective view of a SCUBA diving mask 1 constructed in accordance with the principles of the present invention. The mask 1 comprises a flexible body 2 which forms the framework of mask 1. Integrally molded with body 2 is a tapered skirt 4 which completely surrounds the diver's eyes and includes a nose pocket 6 to enclose the diver's nose as required for SCUBA diving mask to allow equalization of the air space between the mask and the users face during a diving decent. Generally the mask body 2 would be considerably heavier in wall thickness than the skirt 4. The heavy wall thickness of the mask body 2 allows the lenses and the strap to be attached securely (as described below) while the skirt 4 can taper to allow complete sealing of the mask to the diver's face. However, the wall thickness of body 2 is sufficiently thin that the body remains flexible and, in particular, can be folded in half with nose pocket 6 as a centerline.

Both the body 2 and the skirt 4 are molded out of a flexible rubber material, such as neoprene rubber and, preferably, silicone rubber. The construction, materials and molding of a mask body 2 and skirt 4 are well-known.

The mask also comprises two rigid lens pieces, 10 and 12, which are preferably made of tempered glass, but can also be made of plastic material, such as a polycarbonate material. It is important that there be two separate lens pieces so that the flexible body 2 and skin 4 can be folded along the nose pocket 6 to allow the mask 1 to be folded into a small package. Each of the lens pieces, 10 and 12, is attached to the body 2, in a water-tight manner. This can be accomplished by molding a socket 8 into the body 2 and snapping the lenses into the socket, or by cementing the lenses, 10 and 12, into recesses 8 in the body 2 using a silicone rubber adhesive or other suitable adhesive.

The mask 1 is provided with a strap 14 which is generally molded of a flexible rubber material such as silicone rubber. The strap is mounted on the mask body 2 by two strap adjustment mechanisms, of which mechanism 16 is shown. Each of these mechanisms can be one of several well-known designs and the exact mechanism is not of importance with respect to the present invention. Preferably, a thumb-operated, quick-adjust mechanism, such as mechanism 16 shown in FIG. 1 is used. Such a mechanism works with a strap such as strap 16 which is provided with a number of equally-spaced teeth 22 molded into the strap.

Adjustment mechanism 16 consists of a U-shaped housing 18. The housing 18 can be fabricated of a rigid material, such as a polymeric plastic material and then attached to the rubber mask body 2, by either cementing the housing 18 to the rubber material or by molding a protruding "button" in the rubber mask body material which engages a slot in the housing 18 (so that housing 18 slides over the button and "snaps" in place). Alternatively, the housing 18 can be molded of rubber material directly on the side of mask body 2.

The adjustment mechanism further comprises a rigid, spring-loaded latch 26. Latch 26 is attached to the housing 18 by means of a pivot pin 20. The mask strap 14 is wrapped around an anchor pin 30 which is also passes through housing 18 and latch 26 is urged against pin 30 by a spring (not shown). Latch 26 has a tooth 24 which contacts one of the teeth 22 on the mask strap 14 and prevents the strap 14 from being pulled out of the adjustment mechanism.

When a diver desires to adjust the strap, he presses a projection 28 on the latch 26 causing latch 26 to pivot around a pin 20 against the pressure of the spring (not shown ), move tooth 24 away from anchor pin 30 and release the strap 14.

Alternatively, the strap 14 can be wrapped around the anchor pin 30 and the free end of the strap can be attached to the strap by means of well-known clip mechanisms to form a loop of mask strap.

As shown in FIG. 1, the inventive mask 1 can be folded in half using the nose pocket 6 as a center line such that the rigid lenses 10 and 12 fold against each other and the entire mask becomes a small package. This package is small enough that it can then be placed in a pocket, such as buoyancy compensator pocket and used during a dive as a spare mask in the case that the diver's primary mask becomes damaged or lost. The spare mask provides additional redundancy which is particularly desirable for such activities as cave diving.

Alternatively, the inventive mask can be used as a primary mask. It has several advantages when used as a primary mask. First, the inventive mask is much lighter than a conventional mask since the heavy frame is not present and thus the inventive mask is easier to wear for long periods of time. In addition, since the frame is not present, the intensity of the ambient light reaching the diver's eyes through the skirt 4 is much higher than a conventional mask, especially if the skirt 4 is constructed of a translucent material such as un-colored silicone rubber.

Although only one embodiment of the invention has been shown in detail, other modifications and changes will be obvious to those skilled in the art, and the following claims are intended to cover such modifications and changes.

What is claimed is:

1. A collapsible SCUBA diving mask for covering a diver's face, eyes and nose during a compressed air dive, the mask comprising:

a flexible mask body having substantially the width of the diver's face, the body having an interior and a nose pocket communicating with the interior for enclosing the diver's nose, the mask body being sufficiently flexible that it can be folded about the nose pocket when the diving mask is fully assembled;

a flexible skirt integrally molded with the mask body for sealing the mask body to the diver's face;

a pair of rigid lens pieces mounted in the mask body in a water-tight fashion and positioned in front of the diver's eyes;

a mask strap; and a pair of adjustment mechanisms for attaching the mask strap to the mask body.

2. A collapsible SCUBA diving mask according to claim 1 wherein the mask body is fabricated from a rubber material.

3. A collapsible SCUBA diving mask according to claim 2 wherein the mask body is fabricated from silicone rubber material.

4. A collapsible SCUBA diving mask according to claim 1 wherein the mask skirt is fabricated from a rubber material.

5. A collapsible SCUBA diving mask according to claim 4 wherein the mask skirt is fabricated from a silicone rubber material.

6. A collapsible SCUBA diving mask according to claim 1 wherein each of the pair of lens pieces is comprised of tempered glass.

7. A collapsible SCUBA diving mask according to claim 1 wherein each of the pair of lens pieces is comprised of a polymeric plastic material.

8. A collapsible SCUBA diving mask according to claim 1 wherein each of the pair of lens pieces is comprised of polycarbonate material.

9. A collapsible SCUBA diving mask according to claim 1 wherein each of the pair of lens pieces snap into a socket molded into the mask body.

10. A collapsible SCUBA diving mask according to claim 1 wherein each of the pair of lens pieces is cemented into a recess molded into the mask body.

11. A collapsible SCUBA diving mask according to claim 1 wherein each of the pair of adjustment mechanisms comprises a quick-release mechanism having a spring-loaded latch which catches against teeth molded into the strap.

12. A collapsible SCUBA diving mask according to claim 1 wherein each of the pair of adjustment mechanisms comprises a pin attached to a housing, around which pin the mask strap is wrapped and a latch for forming a loop of mask strap about the pin.

13. A collapsible SCUBA diving mask for covering a diver's face, eyes and nose during a compressed air dive, the mask comprising:

a flexible mask body fabricated from silicone rubber and having substantially the width of the diver's face, the body having an interior and an integral nose pocket communicating with the interior for enclosing the diver's nose, the mask body being sufficiently flexible that if can be folded about the nose pocket into two halves when the diving mask is fully assembled;

a flexible tapered skirt integrally molded with the mask body in silicone rubber for sealing the mask body to the diver's face;

a pair of rigid lens pieces mounted in the mask body in a water-tight fashion and positioned in front of the diver's eyes;

a mask strap molded of flexible material; and a pair of adjustment mechanisms for attaching the mask strap to the mask body.

14. A collapsible SCUBA diving mask according to claim 13 wherein each of the pair of lens pieces is comprised of tempered glass.

15. A collapsible SCUBA diving mask according to claim 13 wherein each of the pair of lens pieces is comprised of a polymeric plastic material.

16. A collapsible SCUBA diving mask according to claim 15 wherein each of the pair of lens pieces is comprised of polycarbonate material.

17. A collapsible SCUBA diving mask according to claim 16 wherein each of the pair of lens pieces snap into a socket molded into the mask body.

18. A collapsible SCUBA diving mask according to claim 16 wherein each of the pair of lens pieces is cemented into a recess molded into the mask body.

19. A collapsible SCUBA diving mask according to claim 13 wherein each of the pair of adjustment mechanisms comprises a quick-release mechanism having a spring-loaded latch which catches against teeth molded into the strap.

20. A collapsible SCUBA diving mask according to claim 13 wherein each of the pair of adjustment mechanisms comprises a pin attached to a housing, around which pin the mask strap is wrapped, and a latch for forming a loop of mask strap about the pin.

21. A collapsible SCUBA diving mask for covering a diver's face, eyes and nose during a compressed air dive, the mask comprising:

a flexible mask body fabricated from silicone rubber and having substantially the width of the diver's face, the body having an interior and an integral nose pocket communicating with the interior for enclosing the diver's nose, the mask body being sufficiently flexible that it can be folded about the nose pocket into two halves when the diving mask is fully assembled, said mask body and having two sockets molded therein;

a flexible tapered skin integrally molded with the mask body in silicone rubber for sealing the mask body to the diver's face;

a pair of rigid tempered glass lens pieces, each of the pair of lens pieces being mounted in one of the sockets to form a water-tight seal between each of the lens pieces and the mask body so that one of the pair of lens pieces is positioned in front of one of the diver's eyes;

a mask strap molded of flexible material; and a pair of quick-release adjustment mechanisms for attaching the mask strap to the mask body.

* * * * *